US006670310B2

(12) United States Patent
Wojtecki

(10) Patent No.: US 6,670,310 B2
(45) Date of Patent: Dec. 30, 2003

(54) HIGH PERFORMANCE LUBRICANT FOR METAL PUNCHING AND SHEARING

(75) Inventor: Rudy Wojtecki, Mantua, OH (US)

(73) Assignee: Cleveland Punch and Die Co, Ravenna, OH (US)

( * ) Notice: Subject to any disclaimer, the term of this patent is extended or adjusted under 35 U.S.C. 154(b) by 0 days.

(21) Appl. No.: 10/043,013

(22) Filed: Jan. 11, 2002

(65) Prior Publication Data

US 2002/0137637 A1 Sep. 26, 2002

(51) Int. Cl.[7] ..... C10M 125/26
(52) U.S. Cl. ..... 508/136; 508/450
(58) Field of Search ..... 508/161, 136

(56) References Cited

U.S. PATENT DOCUMENTS 4,084,737 A * 4/1978 Gorman et al. ..... 252/58
4,396,514 A * 8/1983 Randisi ..... 252/30
4,810,395 A * 3/1989 Levy et al. ..... 252/28
5,236,606 A * 8/1993 Rangel ..... 252/28
6,127,320 A * 10/2000 van Ooij et al. ..... 508/138
6,383,991 B1 * 5/2002 Hashimoto et al. ..... 508/161

* cited by examiner

*Primary Examiner*—Ellen M. McAvoy

(57) ABSTRACT

A high performance lubricant to extend the life of tooling to punch holes and shear metals especially thick steel members. The lubricant, due to its modified viscosity, remains on the tool during the process allowing it to provide the necessary coating to reduce the friction developed. Most punching processes mount the tool vertical and the work is held below the tool. Lubricant is applied to the tool prior to punching. A problem with lubricants presently used is the viscosity is so low the lubricant runs off the tool prior to the punching process rendering the lubricant ineffective. The thixotropic index of the lubricant is controlled by addition of fumed silica to provide the proper viscosity to keep the lubricant on the tool and then during the punching process the viscosity is reduced sufficiently by the shear energy applied between the tool and work to allow the lubricant to flow in the shear area thereby providing maximum lubrication between the tool and the work.

5 Claims, 8 Drawing Sheets

HIGH PERFORMANCE LUBRICANT FOR METAL PUNCHING AND SHEARING

Typical Machine for Metal Punching Using Tooling Described in this Invention

HIGH PERFORMANCE LUBRICANT FOR METAL PUNCHING AND SHEARING
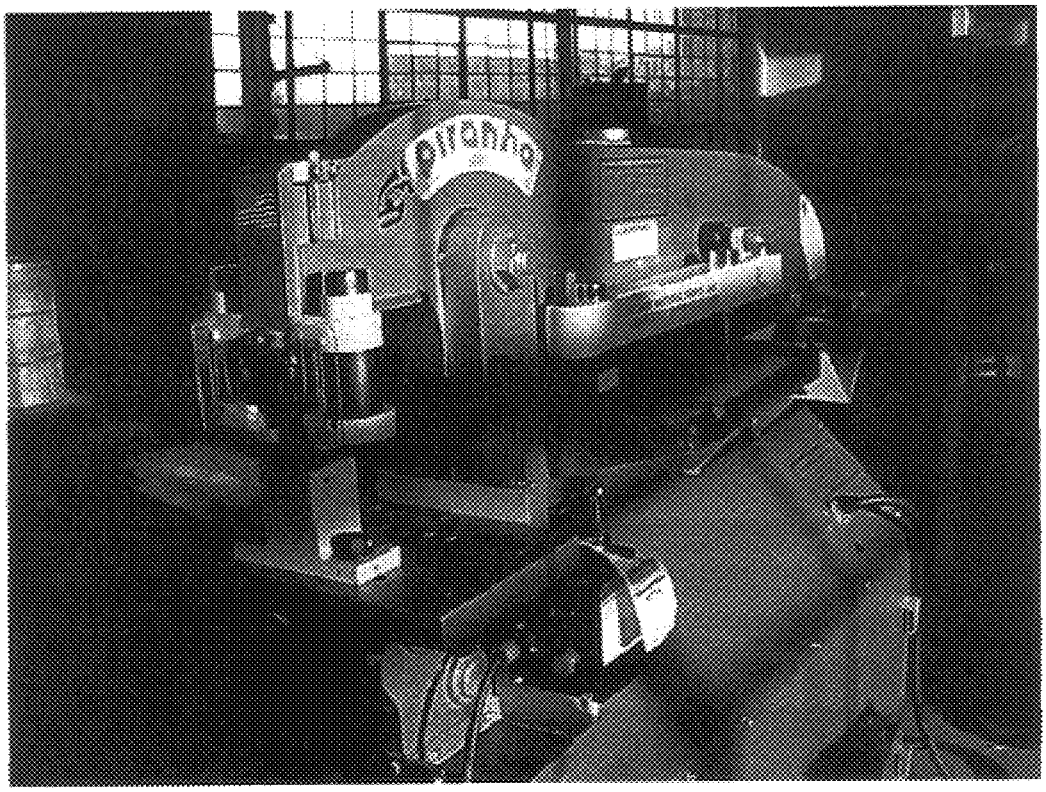
Figure 1 - Typical Machine for Metal Punching Using Tooling Described in this Invention

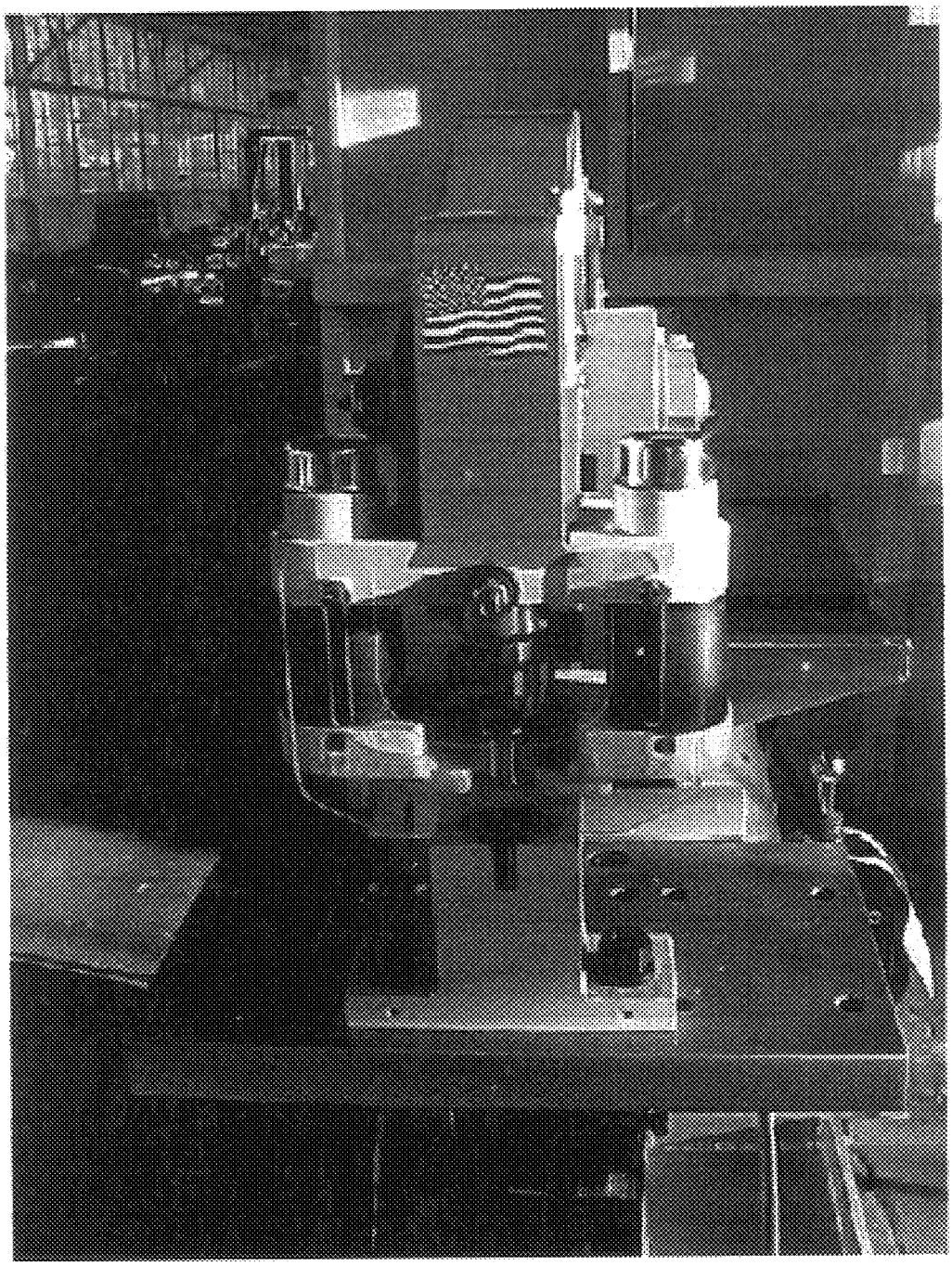
Figure 2 - Front View of Typical Punching Machine Showing Tooling Location and Orientation

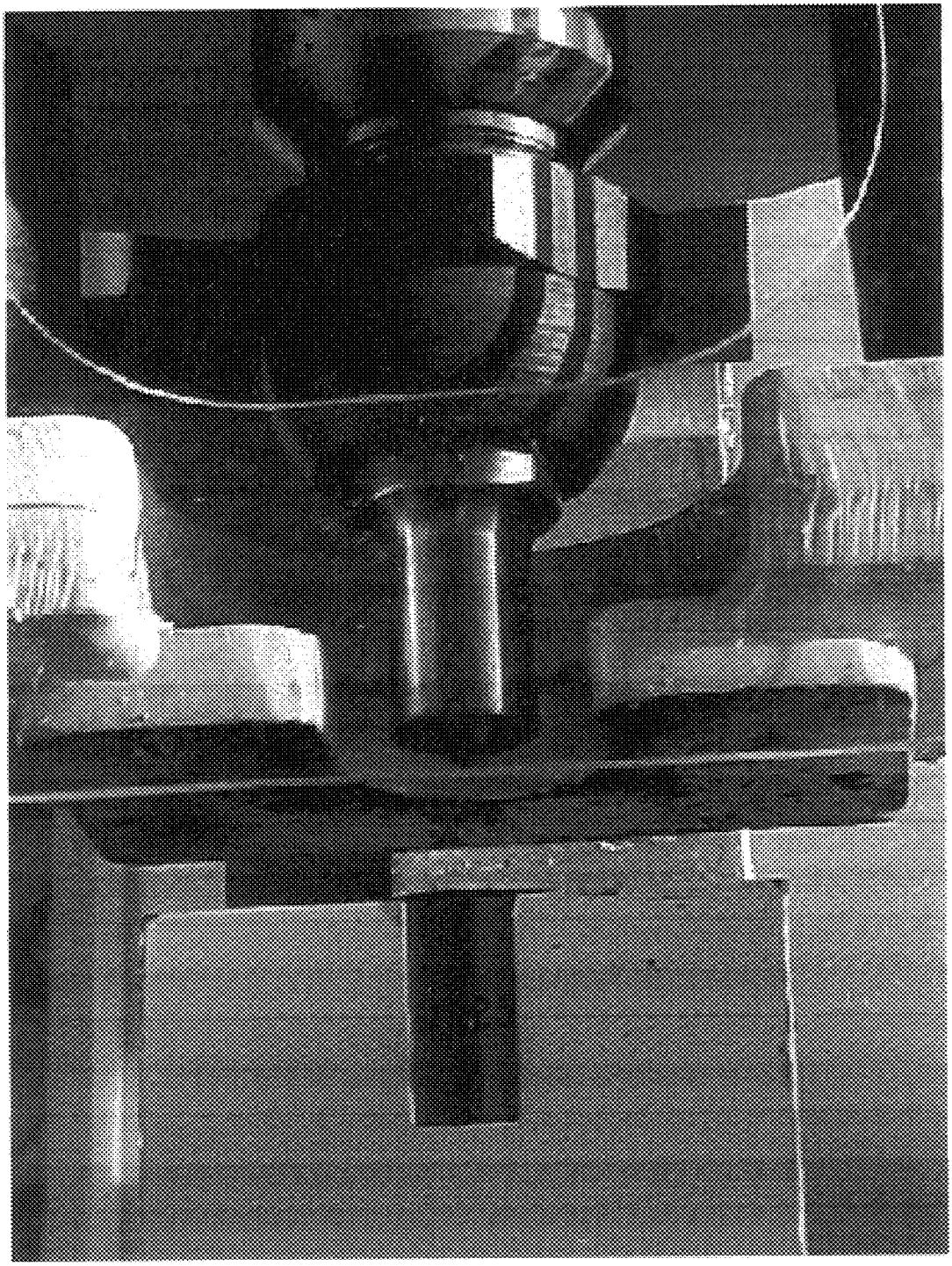
Figure 3 - Typical Tooling Used in the Punching Process

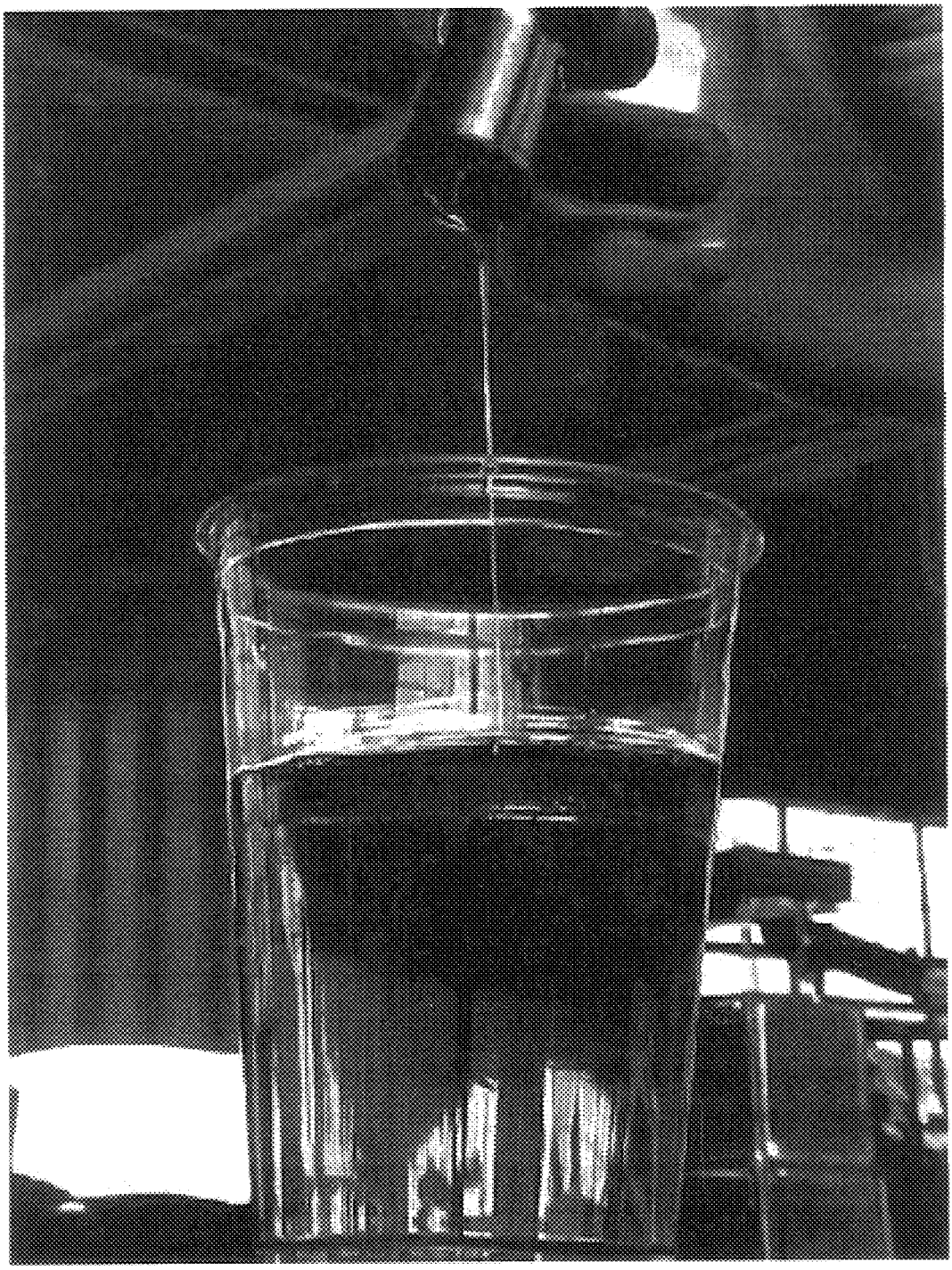
Figure 4 - Lubricant used in Punching Showing Runoff Due to Low Viscosity

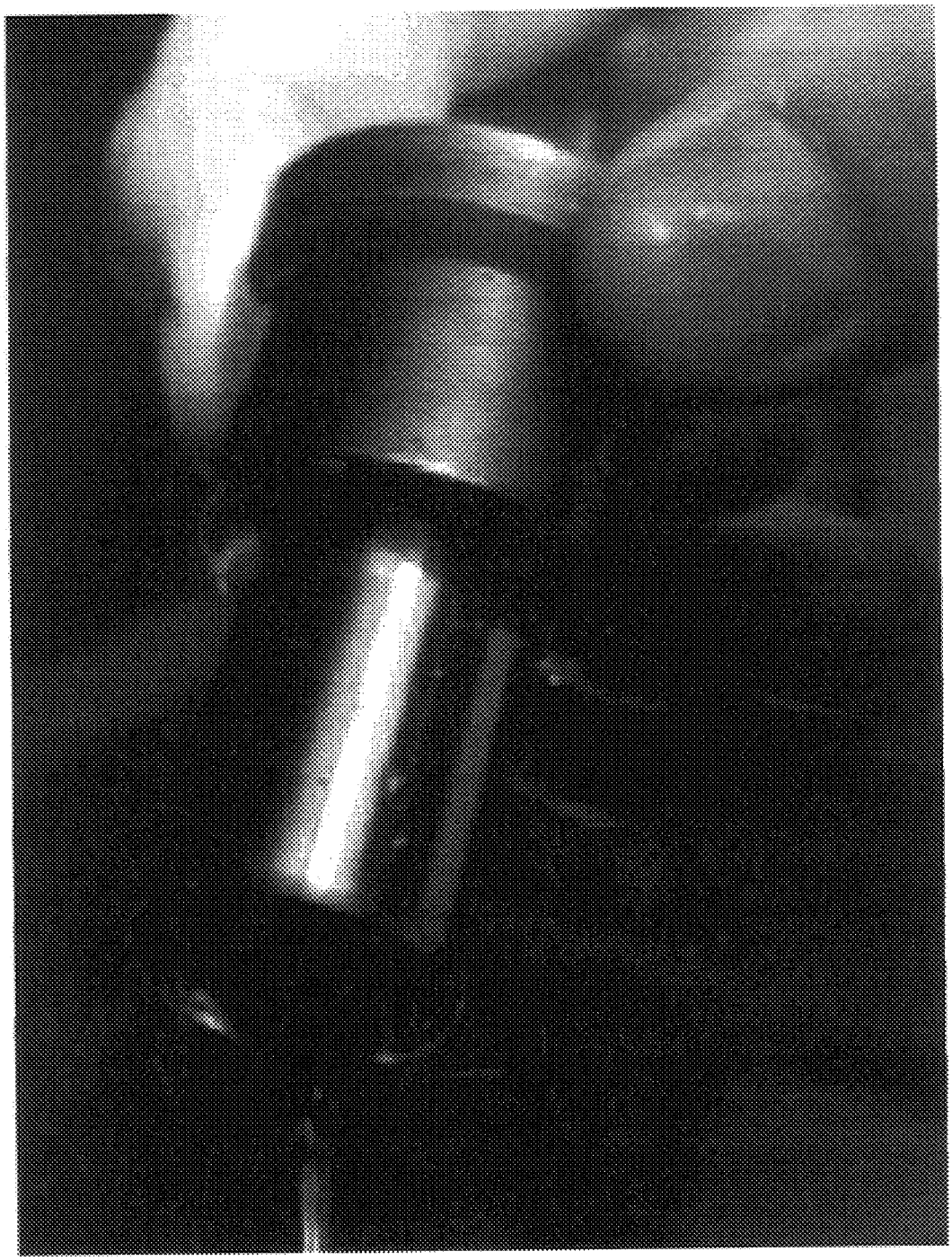
Figure 5 - Closeup of Lubricant Runoff

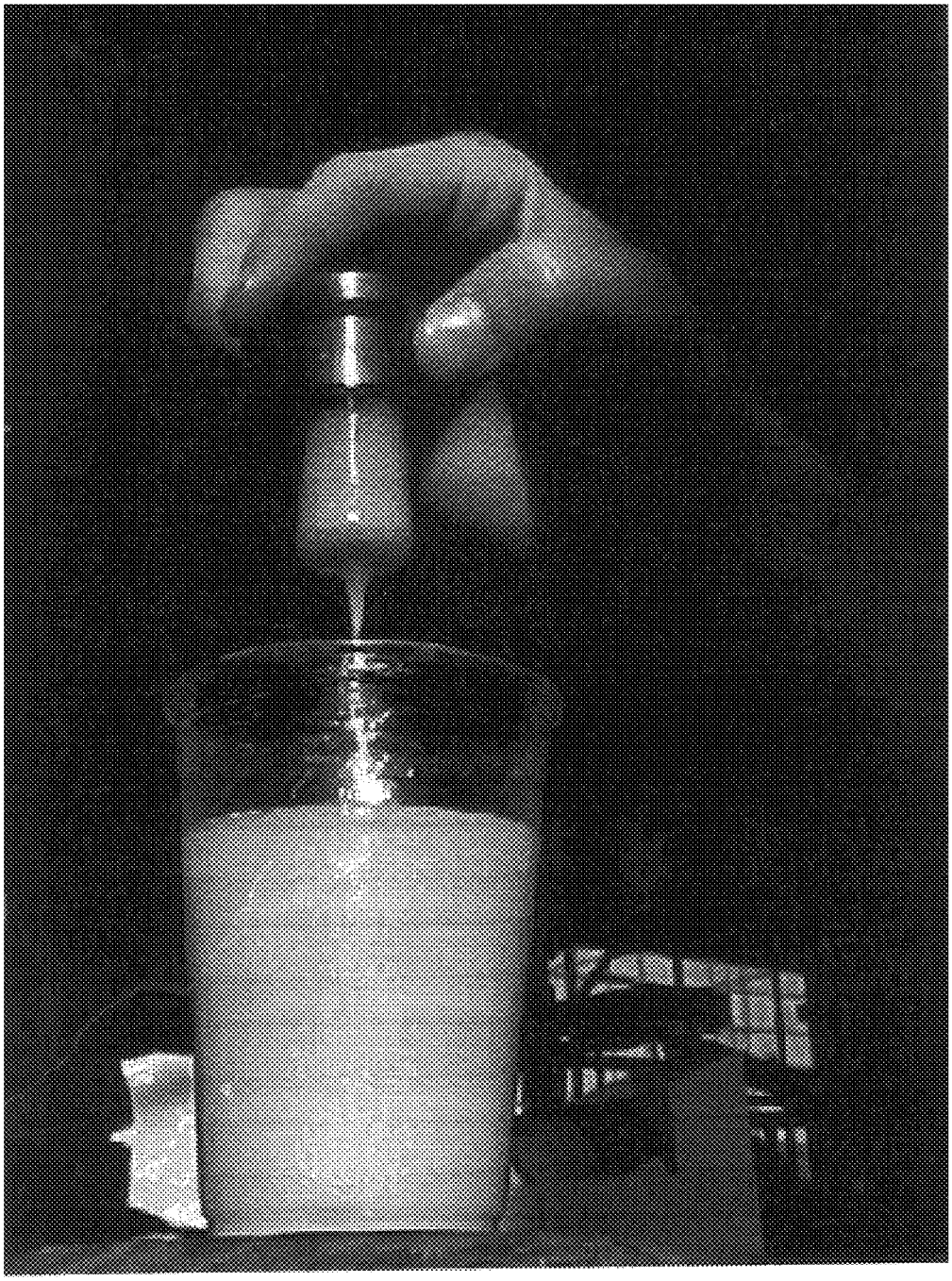
Figure 6 - Modified Lubricant with 3% Fumed Silica

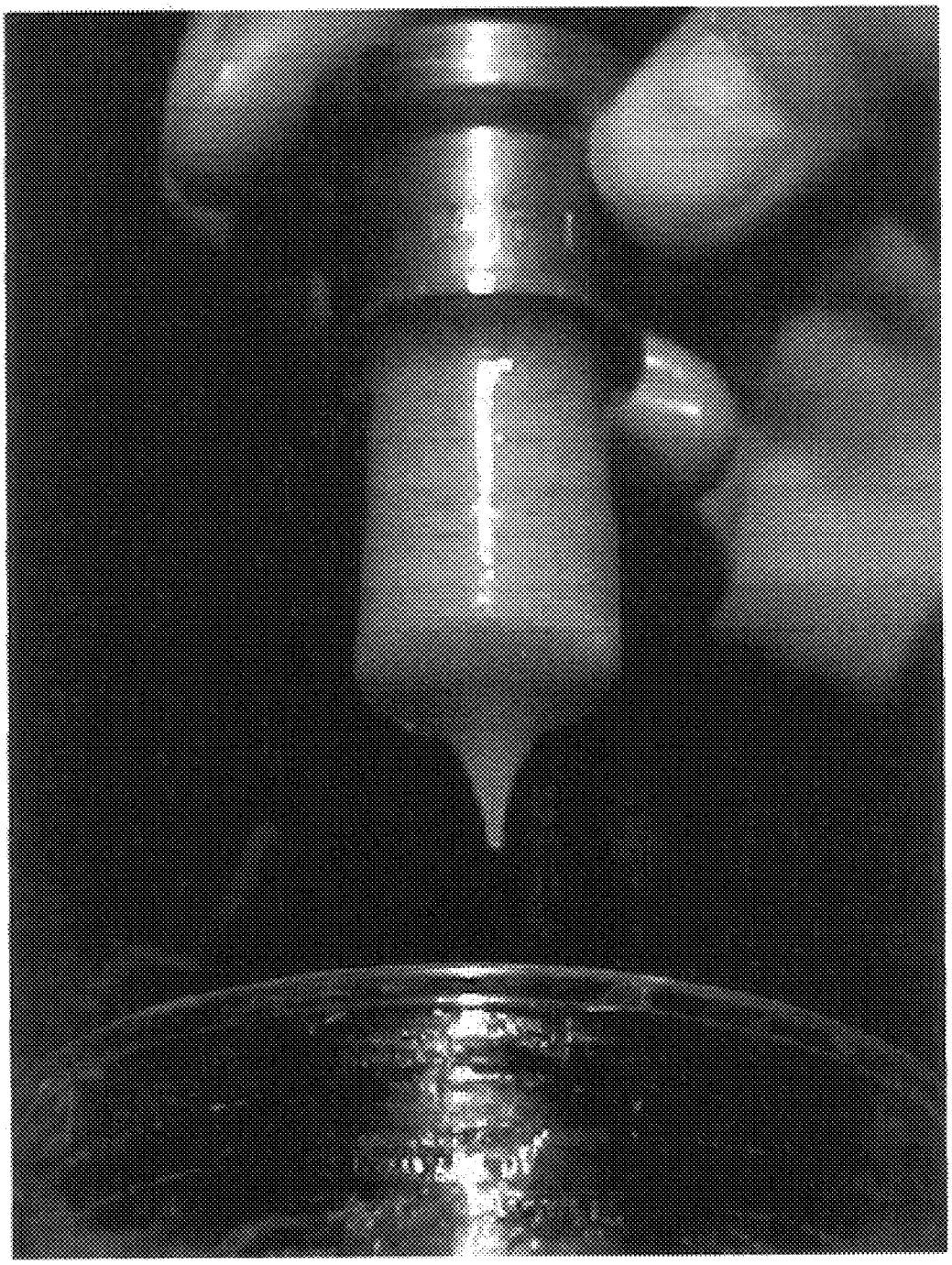
Figure 7- Modified Lubricant Showing Clingage to the Surface

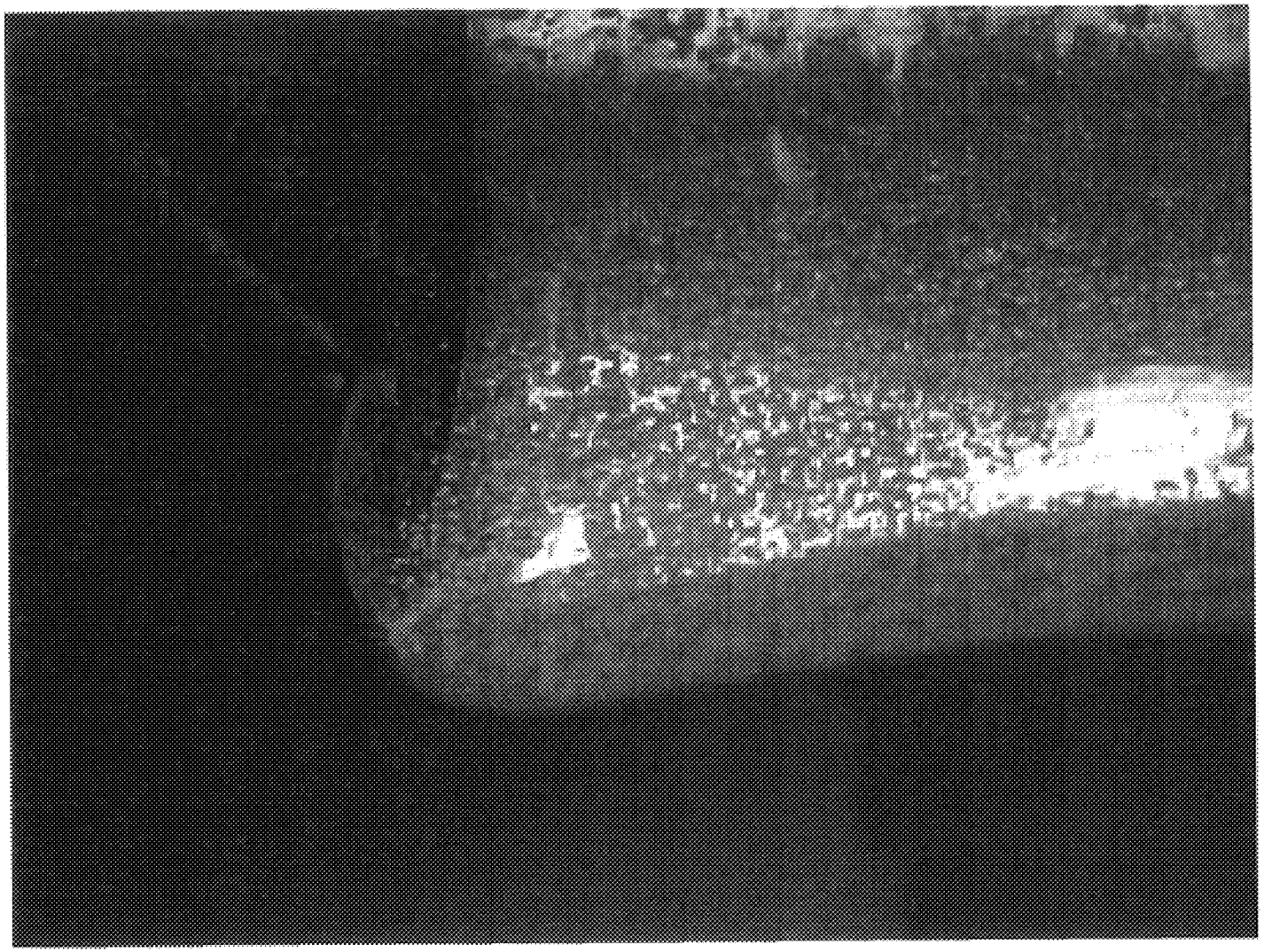
Figure 8 - Closeup of Punch Surface Showing the Lubricant Layer Remaining

HIGH PERFORMANCE LUBRICANT FOR METAL PUNCHING AND SHEARING

BACKGROUND

This invention was conceived to extend the life of tooling used to punch holes in metals especially thick steel members. During the punching process shear energy is developed by the tooling to produce the cut. Friction between the tool (said tool is referred to as a punch) and the metal being punched (said metal is referred to as the work) develops a force normal to the shear forces which develops heat and is detrimental to the tool. This friction force can be reduced by providing a lubricant in the immediate vicinity of the shear area. For maximum effectiveness the lubricant must posses a high amount of lubricity and must be of proper viscosity to be transported to the cutting area and then the viscosity must be much lower to allow flow between the tool and the work.

Most punching processes mount the punch vertical and the work is held below the punch. Lubricant is applied to the punch prior to punching. A problem with lubricants presently used is the viscosity is so low the lubricant runs off the tool prior to the punching process rendering the lubricant ineffective. My invention solves this problem by modifying the viscosity of said lubricant to make it thixotropic. Thixotropy is a property a fluid posses when its viscosity changes with the introduction of shear energy into the fluid. The ratio of the viscosity at low internal shear energy to the viscosity at high internal shear energy is referred to as thixotropic index. The thixotropic index of my invention is controlled to provide the proper viscosity to keep the lubricant on said punch and then during the punching process the viscosity is reduced sufficiently by the shear energy applied between said punch and said work to allow the lubricant to flow in the shear area thereby providing maximum lubrication between the punch and the work.

BRIEF DESCRIPTION OF THE DRAWINGS

FIG. 1 shows a typical machine used far the punching process illustrating an application for the described invention.

FIG. 2 shows a closeup view of the machine in FIG. 1 to better illustrate the application of the invention.

FIG. 3 shows the tooling used in the machine in FIG. 1 to illustrate the details of a typical punch setup.

FIG. 4 shows the runoff experienced when using a low viscosity lubricant on a punch.

FIG. 5 shows a closeup view of a punch illustrating lubricant runoff.

FIG. 6 shows the use of the described invention to coat a punch.

FIG. 7 shows a close up of the described invention illustrating the clingage of the lubricant to the surface of a punch.

FIG. 8 shows a close up of the described invention illustrating, in greater detail, the clingage of the lubricant to the surface of a punch.

DESCRIPTION

It is well known in many trades that the addition of fumed silica will enhance the thixotropic index of fluids. Fumed silica is used in many products from catsup to grease as a viscosity modifier. In my invention the addition of CabOSil M5 amorphous fumed silica having and average particle length of 0.2–0.3 microns made by Cabot, Inc. P.O. Box 188 Tuscola, Ill. 61953-0188 was added to a cutting fluid which is a blend of chlorinated paraffin and naphthionic oil with a specific gravity between 1.2–1.3 with an initial viscosity under 1000 cP at room temperature (40° C.). The optimum loading of fumed silica was determined to be 3% by weight. The optimum viscosity was determined by adding small amounts of fumed silica (CabOSil M5) and evaluating the resulting viscosity after each addition. Several loadings were evaluated up to 3% by weight using a Brookfield viscometer and measuring viscosity at 3 different shear rates. The initial viscosity measured was 950 cP and remained flat at the different shear rates. M5 loading up to 3% increased the viscosity to 32,000 cP with a thixotropic index of 2.1 (15,000 cP at high shear). Very noticeable changes in clingage to the stirring rod were detected as the M5 quantity was increased. After determining that 3% loading produced the desired results test quantities were mixed and evaluated.

The following table (Table #1—Viscosity Test Data) contains select test data from said tests described above. These data illustrate the effect of thixotrope loading based on viscosity measurements at shear rates tested at spindle speeds of 6 RPM and then repeated at 12 RPM for higher shear rate. Note from these data the thixotropy of the fluid increased appreciably over 2.5% loading and that over 2.5% loading runoff after dipping in the fluid was eliminated and that large amounts of the fluid adhered to the stirring rod surface. Application tests were performed to verify these results by dipping actual tools in the fluid with the test loadings. The application tests verified the desirable loading to be at 3%. Photographs used for FIGS. 1 thru 8 show the results of the application tests. Actual field tests show the application of this lubricant extends the life of the tool several times over operation without said lubricant.

TABLE #1

Viscosity Test Data

| Sample # | Thixotrope Loading (%) | Spindle Speed (RPM) | Viscosity (cP) | Change (%) | Observations |
|---|---|---|---|---|---|
| 1 | 0 | 6 | 950 | | Fast runoff, little |
| | | 12 | 925 | 2.6 | clingage |
| 2 | 0.4 | 6 | 950 | | Fast runoff, little |
| | | 12 | 950 | 0 | clingage |
| 3 | 0.7 | 6 | 1200 | | Fast runoff, little |
| | | 12 | 1175 | 2.1 | clingage |
| 4 | 1.06 | 6 | 1425 | | Fast runoff, little |
| | | 12 | 1400 | 1.8 | clingage |
| 5 | 1.33 | 6 | 1775 | | Fast runoff, little |
| | | 12 | 1737 | 2.1 | clingage |
| 6 | 1.74 | 6 | 2250 | | Slower runoff, |
| | | 12 | 2200 | 2.2 | little clingage |
| 7 | 2.25 | 6 | 3000 | | Slower runoff, |
| | | 12 | 2800 | 6.7 | thick clingage |
| 8 | 2.52 | 6 | 4400 | | Slight runoff, |
| | | 12 | 3700 | 15.9 | thick clingage |
| 9 | 2.94 | 6 | 10200 | | No runoff, thick |
| | | 12 | 7950 | 22.1 | clingage |
| 10 | 3.72 | 6 | 32000 | | No runoff, thick |
| | | 12 | 21750 | 32.0 | clingage |

What is claimed is:

1. An improved cutting lubricant which can be applied to a cutting tool which has thixotropic properties optimized to produce desired clingage and lubricity to prevent the lubricant from running off the tool during cutting and provide the desired lubrication during the cutting process, said cutting lubricant comprising:

a. comprised of a blend of chlorinated paraffin and naphthenic oil with a specific gravity between 1.2–1.3 and, b. modified with a loading of 1.74–3.72% by weight fumed silica to increase the viscosity of the lubricant to 2250–32,000 cP with a thixotropic index over 2.

2. A cutting lubricant as described in claim 1 wherein the loading of fumed silica is 3.72% by weight to provide higher viscosity and higher thixotropic index for higher temperature and more severe applications.

3. A cutting lubricant as described in claim 1 wherein the loading of fumed silica is 1.74% by weight to provide lower viscosity for less severe applications and for ease of dispensing.

4. A cutting lubricant as described in claim 1, 2 or 3 wherein the tool is a punch.

5. A cutting lubricant as described in claim 1, 2 or 3 wherein the tool is a shear blade.

* * * * *